United States Patent [19]

Haueter

[11] Patent Number: 4,871,125

[45] Date of Patent: Oct. 3, 1989

[54] STORAGE DEVICE

[75] Inventor: Ernst Haueter, Längenei, Switzerland

[73] Assignee: Autelca AG, Gümligen, Switzerland

[21] Appl. No.: 178,069

[22] Filed: Apr. 5, 1988

[30] Foreign Application Priority Data

May 11, 1987 [CH] Switzerland ..... 01 778/87

[51] Int. Cl.[4] ..... B65H 29/66; B65B 63/04

[52] U.S. Cl. ..... 242/67.3 R; 242/59; 53/118; 53/430

[58] Field of Search ..... 242/67.3 R, 59; 53/118, 53/430

[56] References Cited

U.S. PATENT DOCUMENTS

| | | | |
|---|---|---|---|
| 4,337,864 | 7/1982 | McLean | 242/67.3 R X |
| 4,438,618 | 3/1984 | Honegger | 242/67.3 R X |
| 4,526,362 | 7/1985 | Thierstein | 242/67.3 R X |
| 4,574,557 | 3/1986 | Haberstroth | 242/67.3 R X |

*Primary Examiner*—John M. Jillions
*Assistant Examiner*—Steven M. duBois
*Attorney, Agent, or Firm*—Brady, O'Boyle & Gates

[57] ABSTRACT

Objects (1) to be stored are fed between two rollers (9, 10) to a belt (2) taken off from a belt coil (5) of a belt reel (6) and wound up therewith (2), forming a storage coil (7), onto a storage reel (3). For the delivery of previously stored objects (1*a*), the belt (2) is taken off therewith (1*a*) from the storage coil (7), the objects separate from the belt (2) upon leaving the roller pair (9, 10), the belt (2) being rewound onto the belt coil (b 5). The reels (3, 6) are displaceably mounted; their coils (5, 7) are each supported on a fixedly mounted backing roller (12, 13). For driving the device, the backing rollers (12, 13) can be rotated at coincident peripheral speeds, or respectively one backing roller (12, 13) can be rotated by pulling off the belt (2) from the coil (5, 7) carrying same and the rotation of that backing roller can be transmitted to the other backing roller, or respectively one of the reels (3, 6) can be rotated by pulling off the belt (2) from its coil (5, 7) and the rotation of such reel can be transmitted to the other reel by means of an infinitely variable gear system (42, 43, 46, 47, 51–54, 57–60) in such a way that the peripheral speeds of both coils coincide. In this way, a belt, storage, and delivery speed at constant belt speed is attained which is independent of the respective diameters of the coils.

11 Claims, 3 Drawing Sheets

STORAGE DEVICE

BACKGROUND OF THE INVENTION

The invention relates to a storage device for sheet-like, flexible objects, such as bank notes.

A device of this type intended for the storage of bank notes has been known from British Patent No. A-2,071,059 wherein the bank notes, depending on the design, are wound onto the storage reel on a belt unwound from a belt reel or between two belts unwound from a joint belt reel or from respectively one belt reel. In the type of design with two belts and two belt reels, the drive arrangement includes a drive mechanism, not described in detail, with a speed-controllable motor that is to drive the storage reel in the winding and, respectively, unwinding directions and, at the same time, the belt reels in the unwinding and, respectively, winding directions so that a braking force acts on the reel or reels revolving in each case in the unwinding direction, which force inhibits the rotation of such reel or reels, in order to keep the belts under synchronously uniform tension. This state of the art does not reveal how this is to be achieved by speed control of the motor or by means of the drive mechanism which latter is merely mentioned without detailed data, especially since the traveling motion as well as the tension of each belt depend not only on the number of revolutions of the belt reel and the storage reel, but also on the peripheral speed of the coils, the latter speed being determined by the number of revolutions and the respective outer diameter of the coils, increasing during windup and decreasing during unwinding; in addition, the outer diameter of the storage coil also varies depending on the thickness of the bank notes and on the mutual spacings at which these bank notes are wound up in succession.

In a storage device of a similar type, likewise comprising a storage reel and two belt reels (U.S. Pat. No. A-2,981,492) wherein, for storing the objects, only the storage reel is driven by a motor and, for retrieval of previously stored objects, only the belt reels are driven manually, the belt reels are driven, for attaining equal tensions of the belts, by way of a differential gear (differential). In this arrangement, during the storage operation, the number of revolutions of the storage reel is constant so that the belt tension becomes higher with an increase in the diameter of the storage coil and, at the same time, the braking moment exerted on the belt coils by the differential gear idling at that time becomes smaller.

SUMMARY OF THE INVENTION

The invention intends to provide a remedy in this connection. The invention, as characterized in the claims, achieves the objective of providing a storage device for sheet-like, flexible objects, especially bank notes, wherein the belt speed and the belt tension are independent of the respective operating condition, i.e. independent of the inversely changing diameters of the storage coil and the belt coil or coils.

Due to the fact that the drive arrangement acts primarily on the belt or belts, rather than on the reels, a constant peripheral speed of the coils can be attained in a simple and reliable fashion, although the diameter of the coil or coils revolving in the windup direction increases and the diameter of the coils simultaneously rotating in the unwinding direction decreases. Consequently, the number, the thickness, and the mutual spacing of the objects stored in the respective operating condition has no effect on the belt tension, either.

In one embodiment, the driven rollers engage at the periphery of the coils, acting on the belt or belts. In this arrangement, the rollers can be constituted by backing rollers fixedly mounted to simplify their drive means, for the coils of the reels mounted to be displaceable perpendicularly to their axis.

Another embodiment comprises a pair of rollers drivable for taking off the belt or belts from the belt reel or reels in one direction and for taking off the belt or belts from the storage coil in the opposite direction, and a gear arrangement which transmits the rotation of the coil or coils respectively revolving in the unwinding direction to the coil or coils in the windup direction of the latter so that their peripheral speeds to maintain the belt tension are at least approximately in coincidence.

When using this gear arrangement, the above-mentioned object can also be attained by driving one of the running wheels of the gear arrangement.

In order to maintain a desired belt tension, the drive arrangement of the storage device according to the invention can be designed so that the peripheral speed of the coil or coils respectively revolving in the windup direction is slightly higher than that of the coil or coils simultaneously revolving in the unwinding direction; in this connection, a torsionally elastic clutch absorbing the tension force of the belt or belts is suitably to be provided, along with a torque transmission with slippage, limiting the belt tension, especially if the elongation elasticity of the belt or belts is very low.

BRIEF DESCRIPTION OF THE DRAWINGS

The invention will be described in greater detail below with reference to the schematic drawings which merely depict embodiments; in the drawings.

DESCRIPTION OF THE PREFERRED EMBODIMENT

Figure 1:
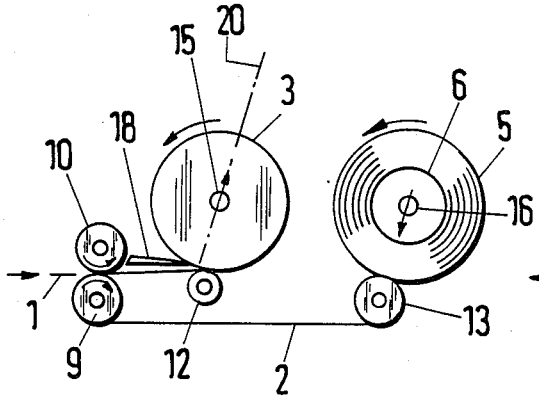
FIG. 1 shows a schematic view, in principle, of a storage device with a belt during the storage procedure.

The bank notes 1 (or other leaf-like, flexible objects) are wound up according to FIG. 1 in contact with a belt 2 onto a storage reel 3. During this process, the belt 2 is unwound from a belt coil 5 on a belt reel 6 and a storage coil 7 is formed on the storage reel 3. The belt 2 revolves around a roller 9 of a pair of rollers 9, 10, the bank notes 1 being fed to the belt 2 between these rollers of the roller pair. In order to facilitate winding up of the bank notes, the storage reel 3 has a larger diameter than the belt reel 6.

Figure 2:
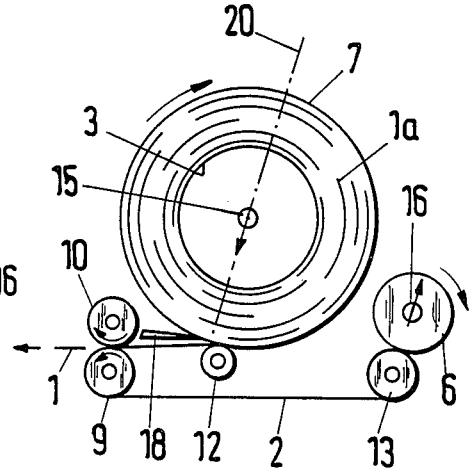
FIG. 2 shows an illustration corresponding to FIG. 1 during the issuance of the previously stored objects.

For the issuance or delivery of previously stored bank notes 1, the belt 2, according to FIG. 2, is pulled off from the storage coil 7, together with stored bank notes 1*a*, and wound up on the belt reel 6 after the bank notes have detached themselves from the belt 2 after leaving the pair of rollers 9, 10.

FIG. 1 illustrates the condition wherein the belt 2 has not as yet been utilized for storage and is wound up with almost its entire length onto the belt reel 6, forming the belt coil 5. FIG. 2 shows the condition wherein the belt 2 has been wound with almost its entire length onto the storage reel 3, forming the storage coil 7. As can be seen, the diameters of the coils 5 and 7 change considerably during operation.

The storage reel 3 and, respectively, its storage coil 7, are supported on a fixedly mounted backing roller 12; the belt reel 6 and, respectively, its belt coil 5 are supported on a likewise fixedly mounted backing roller 13. In order to make this possible with the diameters of the coils 5 and 7 changing during operation, the reels 3 and 6 are mounted to be displaceable perpendicularly to their axles 15 and 16. Thereby, the objective is achieved that the axle 15 of the storage reel 3 will be distanced increasingly with increasing diameter of the storage coil 7 from the backing roller 12 at which the belt 2 with the bank notes travels onto the storage coil 7 and is unwound therefrom; and this permits a short path for the belt 2 to which the bank notes are adhering between the roller pair 9, 10 and the point where the belt runs beside the backing roller 12 onto the coil or runs off therefrom. This is important, because each bank note must be held along this route between the rollers 9 and 10 on the belt 2 and/or must be held so that it projects somewhat into the storage coil 7 in order to reliably transport the bank note along this way. If the storage reel axle 15 were to be supported in a fixed fashion, as is customary, then this route would have to be dimensioned longer with consideration toward the maximum diameter of the storage coil 7, and the route would change in dependence on the diameter of the storage coil 7; in such a case, it would be impossible or at least substantially more cumbersome to arrange a stripper 18 ensuring the detachment of the bank notes during unwinding of the belt 2 from the storage coil 7. The increase in distance of the axle 15 of the storage reel from the roller pair 9, 10 with increasing diameter of the storage coil 7 is additionally enlarged due to the fact that the displacement line 20 of this axle with respect to the route taken by the belt between the roller pair 9, 10 and the storage coil 7 is an obtuse angle. Thereby, the point at which the belt runs onto the coil 7 or runs of therefrom also changes its location to a lesser extent.

Owing to the fact that also the belt reel 6 and, respectively, the belt coil 7 are supported on the fixedly mounted backing roller 13, a belt length along the way from one coil to the other is obtained which is independent of the respective outer diameter of the two coils 7 and 5. This is essential for a constant belt tension. At the transition between the belt coil 5 and the backing roller 13, the belt 2 extends in an S shape. As a result, the reels 3 and 6, as well as their backing rollers 12 and 13, always revolve in the same direction. This simplifies the design of the gear arrangement described hereinbelow.

The other embodiment of the storage device wherein the bank notes are wound between two belts onto the storage reel or storage coil differs in its basic structure from that described in conjunction with FIGS. 1 and 2 in that a second belt is guided around the roller 10 of the roller pair, and the two belts are wound either jointly in superposition onto one belt reel or are individually wound onto their own belt reel. On account of the fact that the bank notes are here held along their route from the roller pair to the storage coil and conversely between the two belts, the length thereof plays a lesser part. Yet, a support for the storage reel or storage coil and a support for the belt reel or reels and, respectively, coil or coils, on backing rollers is also advantageous in this embodiment because thereby a length of the belt between the coils is obtained that is independent of the diameter of the coils and, furthermore, the gear system described hereinbelow can be designed in a simple way with a transmission ratio dependent on the diameter of the coils. Even if rollers are employed engaging the belt or belts on the outside of the coils, as likewise described below, the drive therefor is simpler if these rollers are fixedly mounted backing rollers of displaceably guided coils.

Figure 3:
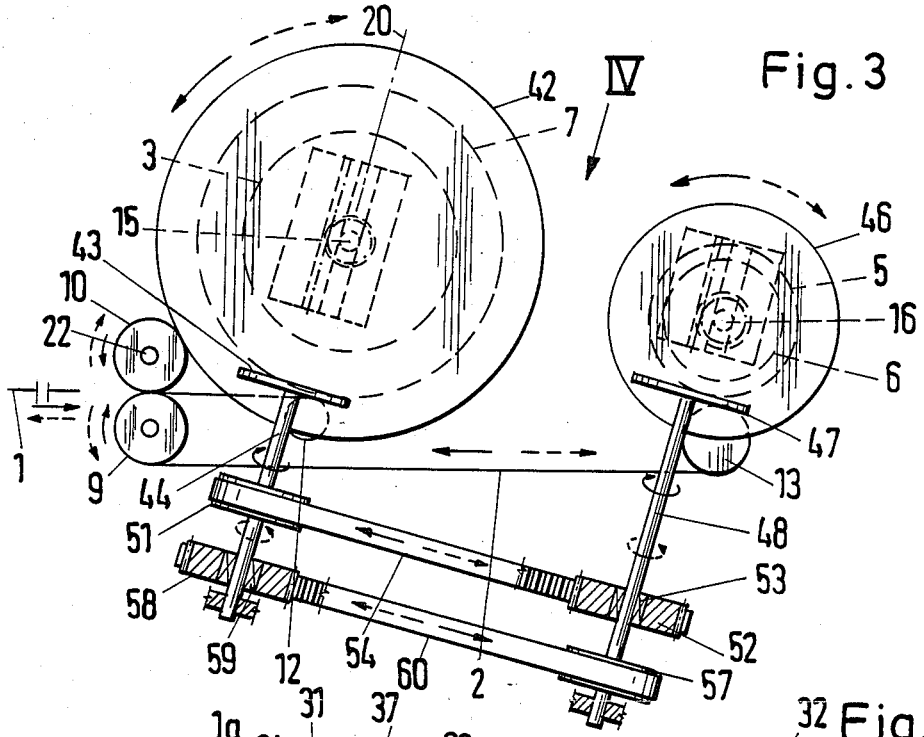
FIG. 3 is a lateral view of a storage device with one belt.
Figure 4:
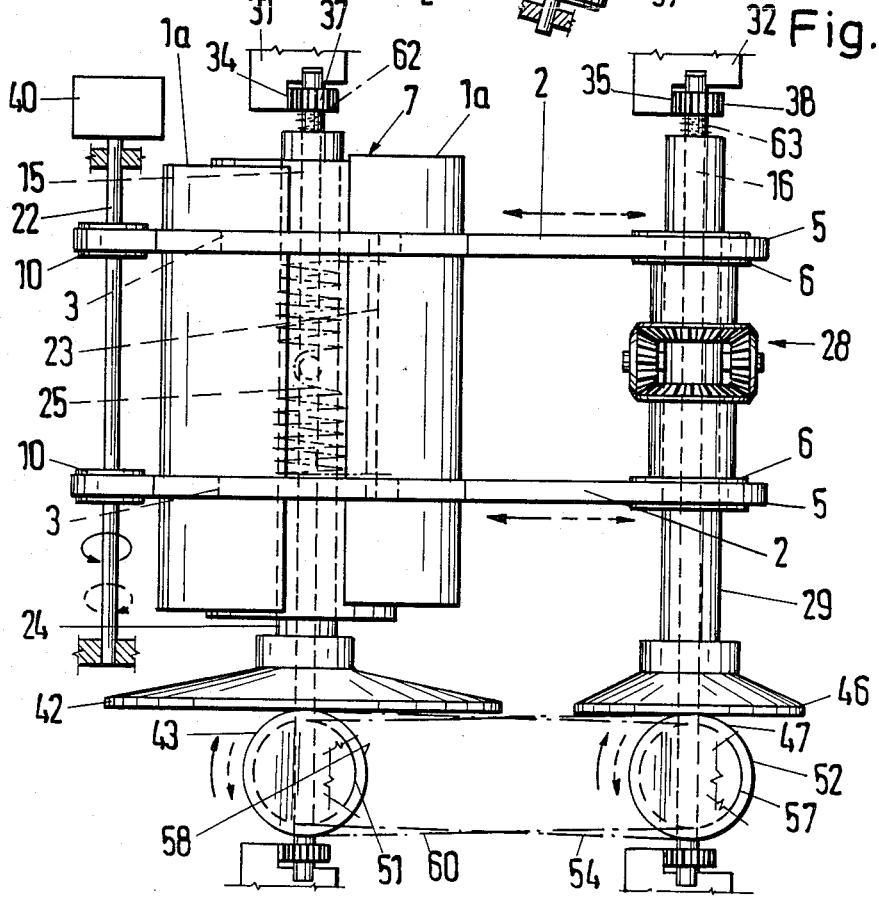
FIG. 4 shows an oblique top view in the viewing direction IV of FIG. 3.

In the embodiment illustrated in FIGS. 3 and 4, the belt 2 consists of two steel bands having, for example, a thickness of 0.05 mm and a width of 6 mm; with given dimensions of the device, this provides a very long belt length and a high storage density, and a high abrasion resistance on the rollers 9, 10 and backing rollers 12 and 13, as well as at the stripper 18. Both steel bands travel jointly, are wound up and unwound jointly, and act jointly, as has been described in connection with FIGS. 1 and 2. Correspondingly, the rollers 9 and 10, the reels 3 and 6, and the backing rollers 12 and 13 likewise consist in each case of two parts. These parts of roller 10 are seated on a joint shaft 22; the same holds true correspondingly for roller 9. The parts of the storage reel 3 are connected for joint rotation by means of a rod 23 and are supported jointly rotatably on a quill shaft 24 and rotationally elastically connected with this shaft by means of a torsion spring 25. The quill shaft 24 is rotatably mounted on the axle 15. The reel parts of the belt reel 6 are each connected to one of the two sun gears of a differential gear 28 (differential), the planetary gear carrier of which is seated on a quill shaft 29 rotatably supported on the axle 16 of the belt reel 6.

In order to mount the reels 3 and 6 in a displaceable fashion as explained in connection with FIGS. 1 and 2, the ends of their axles 15 and 16, respectively, are displaceable in a guide means 31 and 32, respectively, the latter being equipped with a rack 34 and 35, respectively, extending in the guiding direction; a gear wheel 37 and 38, respectively, seated on the axle end and ensuring parallel guidance meshes with this respective rack.

The rollers 9 and 10 of the roller pair are joined by means of a pair of gear wheels (not shown) and are driven by means of a reversible drive motor 40 in one direction for storing bank notes and in the opposite direction for issuance of previously stored bank notes. In FIGS. 3 and 4, the directions of rotation of the individual parts and the travel direction of the belt during the storing of bank notes are indicated by solid arrows while they are indicated during issuance of previously stored bank notes by dashed-line arrows.

A crown gear 42 is seated on the quill shaft 24 of the storage reel 3, the quill shaft being displaceable along the displacement line 20. A running gear 43 travels along the crown gear and is seated on a fixedly supported shaft 44 extending in the direction of line 20; this running gear is arranged so that it travels on a circle of the crown gear 42, the diameter of which corresponds to the diameter of the storage coil 7 on the storage reel 3. For this purpose, the plane of the running gear 43 perpendicular to the displacement direction 20 of the reel 3 extends on or close to the line at which the backing roller 12 touches the coil 7. Thereby, the objective is achieved that the peripheral speed of the running gear 43 corresponds to the peripheral speed of the storage coil 7 and thus to the belt speed. Correspondingly, a crown gear 46 is seated on the quill shaft 29 pertaining to the belt reel 6; a running gear 47, disposed on a fixedly mounted shaft 48, travels on this crown gear 46 at a peripheral speed corresponding to the peripheral speed of the belt coil 5. The two running gears have the same diameter.

The running gear shafts 44 and 48 are connected by means of two belt drives 51 through 54 and 57 through 60. A belt pulley 51 of the first belt drive is fixedly seated on the shaft 44; the other pulley 52 is mounted on the shaft 48 by means of an overrun clutch 53 which latter transmits to the pulley 52 only a rotation of the shaft 48 in the direction corresponding to the windup direction of the reel 6. The pulley 51 has a somewhat smaller diameter than the pulley 52. The band 54 is suitably a serrated belt. The belt pulley 57 is fixedly seated on the shaft 48; the other belt pulley 58 is mounted on the shaft 44 by means of an overrun clutch 59 transmitting only the rotation of the shaft 44 corresponding to the windup direction of the reel 3 to the pulley 57 by way of the belt 60. The diameter of pulley 57 is somewhat smaller than the diameter of pulley 58.

For storing bank notes, the pair of rollers 9, 10 is driven by the motor 40 in the direction shown by the solid arrows. During this process the belt 2 is pulled off the belt coil 5. The gear arrangement consisting of the two friction gear units 42, 43 and 46, 47 and the two belt drives 51–54 and 57–60 transmits the rotation of the belt reel 6 to the storage reel 3 in order to wind the unwound belt 2, together with bank notes fed between rollers 9 and 10, onto the storage reel 3 or storage coil 7. In this process—as will be described in greater detail below—the peripheral speed of the storage reel 3 or storage coil 7 revolving in the windup direction is somewhat higher than the peripheral speed of the belt coil 5 rotating in the unwinding direction whereby the belt 2 is held in tensioned condition. The difference between the windup and unwinding velocities is absorbed by the torsion spring 25; in case of excess belt tension, the limit of frictional adherence of one or both tracking wheels 43 and 47 on the crown gears 42 and 46 is exceeded so that slippage occurs which limits belt tension. This adhesive friction is determined by compression springs 62 and 63, one of which engages between one of the gear wheels 37 and the quill shaft 24 and the other of which engages between one of the gear wheels 38 and the quill shaft 29 in order to urge the crown gear 42 against the running gear 43 and, respectively, the crown gear 46 against the running gear 47. In this arrangement, a slip ring, not shown, is provided between the gear wheel 37 or 38 and the spring 62 or 63.

The tracking wheel 47 is driven by the face wheel 46 at a peripheral speed corresponding to the peripheral speed of the belt coil 5 in the direction associated with the unwinding rotation of the belt coil 5. Upon the corresponding revolution of the shaft 48, the overrun clutch 53 is engaged so that the pulley 52 transmits the rotation of the shaft 48 by means of the belt 54 to the pulley 51 fixedly seated on the shaft 44. On account of the differing diameters of the pulleys 52 and 51, the number of revolutions of the shaft 44 and thus the peripheral speed of the running gear 43 are somewhat higher than that of the running gear 47, and the peripheral speed of the storage coil 7 (in its windup direction) is somewhat higher than that of the belt coil 5 so that the belt 2 is maintained in the tensioned condition. The pulley 57 fixedly attached to the shaft 48 drives, by way of the strap 60, the belt pulley 58 which revolves, on account of the differing diameters of the belt pulleys 57 and 58, as well as 51 and 52, more slowly than the belt pulley 51 and, respectively, the shaft 44. With the corresponding speed difference in the respective direction of rotation, the overrun clutch 59 idles, and the second belt drive 57–60 is ineffective.

For the issuance of previously stored bank notes, the pair of rollers 9, 10 is driven by the motor 40 in the direction of the arrows shown in dashed lines. In this connection, the belt 2 wound up onto the storage reel 3 together with bank notes la, forming the storage coil 7, is pulled off the storage coil 7, releasing previously stored bank notes while leaving the pair of rollers 9, 10. The pulling off of the belt 2 from the storage coil 7 brings about a revolution of the storage reel 3, transmitted to the belt reel 6 by the gear arrangement in order to wind the pulled-off belt onto the belt reel 6 or the belt coil 5. Also in this case, the peripheral speed of the reel 6 driven by the gear arrangement is somewhat higher than that of the driving reel 3 in order to maintain the belt, as mentioned, in the tensioned condition. The friction gear units operate, apart from the different direction of rotation, analogously as described for the storage procedure. In the direction of rotation of shaft 44 indicated by the dashed-line arrow, the overrun clutch 59 is engaged, and the belt pulley 58 of the second belt drive drives the pulley 57 fixedly seated on shaft 48, the number of revolutions of this pulley 57 being somewhat higher than that of pulley 58. The pulley 51 of the first belt drive, fixedly seated on the shaft 44, drives the pulley 52 by way of the strap 54, the number of revolutions of this pulley 52 being lower than that of the pulley 51 and thus also lower than that of the pulley 57 and of the shaft 48. At the difference of the speeds of shaft 48 and pulley 52 and the respective direction of rotation, the overrun clutch 53 is idling, and the gearing of the belt drive 51–54 is ineffective.

Figure 5:
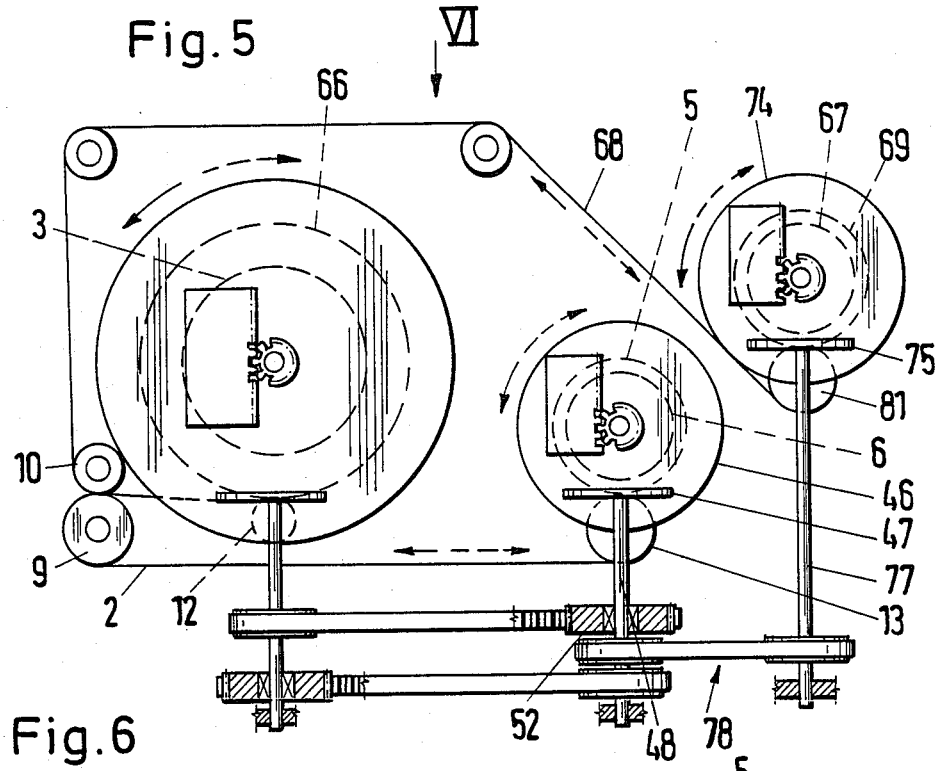
FIG. 5 shows a view corresponding to FIG. 3 of a storage device having two belts.
Figure 6:
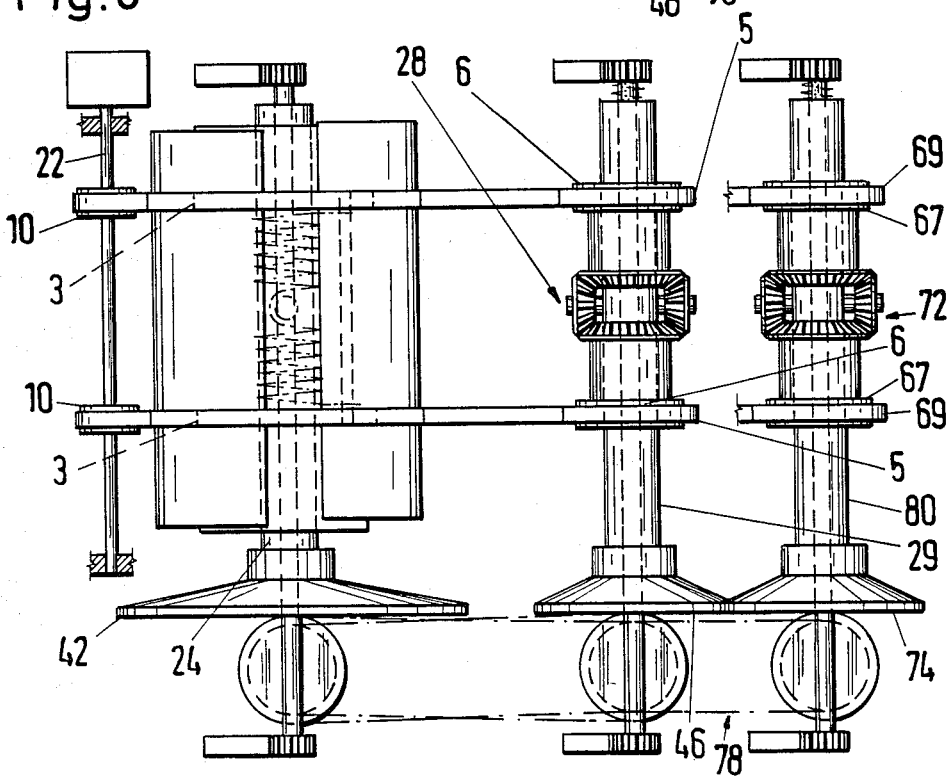
FIG. 6 is a top view in viewing direction VI of FIG. 5.

The embodiment shown in FIGS. 5 and 6 differs from that described in connection with FIGS. 3 and 4 in that the bank notes are wound up between two belts 2 and 68 onto the storage reel 3, forming the storage coil 66. Accordingly, in addition to the belt reel 6 with the belt coil 5, a second belt reel 67 is provided on which is wound up the second belt 68 into a second belt coil 69. The second belt reel 67 is designed in correspondence with the belt reel 6 and is equipped with a differential gear 72. The second belt reel 67 is associated with a friction gear unit corresponding to the friction gearing 46, 47, with a crown gear 74 and a running gear 75. The shaft 77 of the running gear 75 is connected by means of a band drive 78 with a speed ratio of 1:1 with the shaft 48 of the running gear 47. In this embodiment, with two belts 2 and 68, differences in the tensions of the two belts could be compensated for by means of a differential gear, as is known from the storage device according to the above-mentioned U.S. Pat. No. A-2,981,492. For this purpose, a third differential gear (not shown) would have to be included, one sun gear of which would have to be connected to the corresponding quill shaft 29 of one belt reel 6, the other sun gear of which would have to be connected to the corresponding quill shaft 80 of the second belt reel 67, and the planetary gear carrier of which would have to be connected to the pulleys 52 (with overrun clutch 53) and 57. The rotationally elastic clutch (torsion spring 25) can be provided, in the embodiment with one belt (FIGS. 3 and 4), instead of at the storage reel 3, also at the belt reel 6 and, in the embodiment with two belts (FIGS. 5 and 6) each of the two belt reels 6 and 67 can correspondingly be equipped with a rotationally elastic clutch.

Since in the embodiments described with reference to FIGS. 3 and 4 and, respectively, 5 and 6, the pair of rollers 9, 10 and the tracking wheels 43, 47 and, respectively, 43, 47 and 75, perforce revolve at almost identical peripheral velocity, it is also possible to provide that the shaft 44 or 48 or 77 be driven, instead of the roller pair 9, 10. Accordingly, instead of motor 40, a reversible motor could also be provided for driving one of these shafts.

Since also the backing rollers 12 and 13 or, respectively, 12, 13 and 81 rotate with almost the same peripheral speed corresponding to the operating speed of the belt 2 or belts 2 and 68, the backing rollers can also be driven with coincident peripheral velocity, in case of equal roller diameters with a coinciding number of revolutions, especially since they are fixedly supported which simplifies their drive. In this type of drive arrangement, the drive mechanism is especially simple. However, if the belt or belts are subdivided into two narrow band parts, the friction of which against the backing rollers is low, and if the backing roller of the storage coil is designed to be of such a length that it contacts the entire coil, then its friction against the coil is higher than its friction against the band parts. This is disadvantageous for the winding up and unwinding of the storage coil. For this reason, a drive means for the backing rollers would be considered primarily if the belt or belts are not subdivided, and its or their width corresponds to the length of the storage reel and thus also of the belt reel or reels. In this case, there is no need for the friction gear unit 42, 43 and 46, 47 or 74, 75; the backing roller 12, 13 or 81 is to be arranged directly on the shaft 44 or 48 or 77, and the statements apply that were made in connection with the pulley drives 51–54, 57–60 and 78, if the backing rollers 12 and 13, as well as optionally 81 have identical diameters. In place of the motor 40, a reversible motor is to be provided in this arrangement, for driving one of the shafts 44, 48 or 77, and the pulley drives have the effect that the windup speed when storing bank notes as well as when dispensing previously stored bank notes is somewhat higher than the unwinding speed in order to keep the belt or belts in the tensioned condition.

Figure 7:
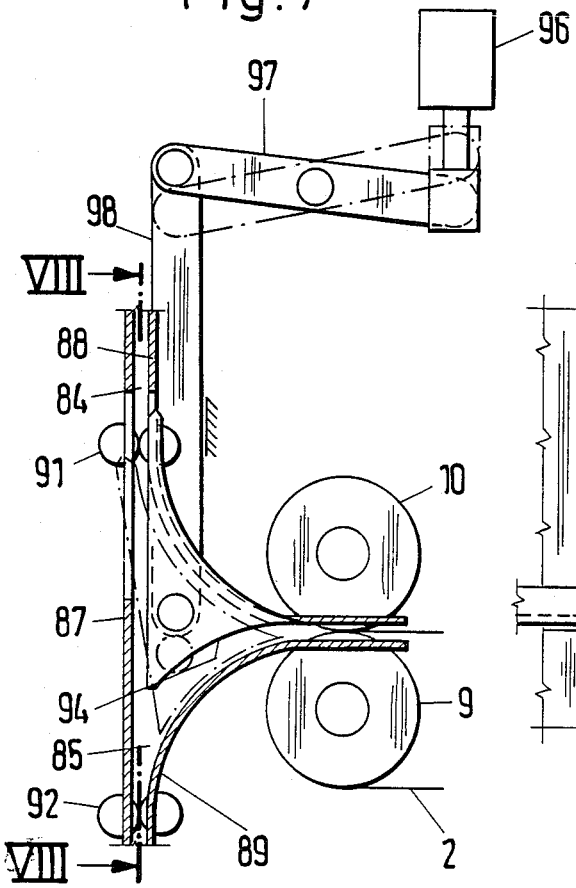
FIG. 7 shows a means for feeding objects to be stored and for carrying away previously stored objects in connection with the device of FIGS. 1–4 or 5 and 6, in a sectional view along line VII—VII in FIG. 8.
Figure 8:
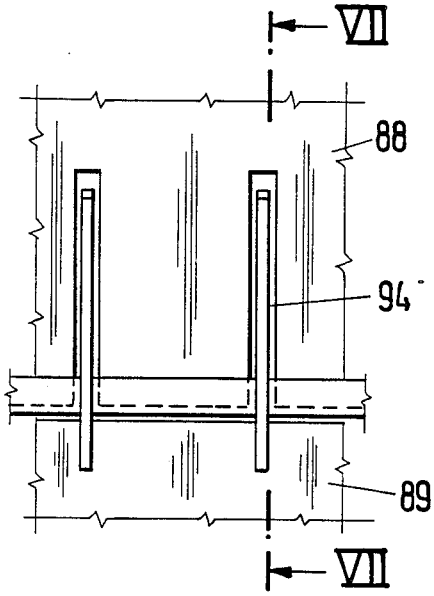
FIG. 8 shows a section along line VIII—VIII in FIG. 7.

FIGS. 7 and 8 show a conveyor track with a conveying route 84 for bank notes to be stored and to be fed to the roller pair 9, 10, and a conveying route 85 for previously stored bank notes to be dispensed which have been detached from the belt 2 after leaving the roller pair 9, 10. This conveyor track consists of baffles 87, 88, 89 with conveyor roller pairs, of which only two are illustrated and are denoted by 91, 92, and is equipped with a switch having switch core members 94. The baffle 87 constitutes the conveying route 84 together with the baffle 88 and the roller pairs 91, and the conveying route 85 together with the baffle 89 and the pair of conveying rollers 92. The baffles 88 and 89 comprise curved portions converging toward the contact line of the roller pair 9, 10. The switch core members 94 can be moved by an electromagnet 96 with a lever linkage 97, 98 into two positions. In the position shown in solid lines, the core members 94 define, together with the curved portion of the baffle 89, a connecting route leading from the roller pair to the conveying route 85; in the position illustrated in dot-dash lines, they define, together with the curved portion of the baffle 88, a connecting route adjoining the conveying route 84 to the roller pair 9, 10. The pairs of conveying rollers 91 and 92 are driven at a peripheral speed corresponding to the travel velocity of the belt; if the conveying route leads to the roller pair 9, 10, the conveying roller pairs are driven at the peripheral speed of the roller pair 9, 10. Thereby, perfect collaboration is ensured in a simple way, i.e. coincidence of the storage speed or delivery speed of the storage device with the conveying speed of its conveying route. The friction gear wheels and the rollers engaging the belt can be provided with a friction coating in all embodiments.

I claim:

1. A storage device for sheet-like, flexible objects, especially bank notes, having a belt (2) connected between a belt reel (6) and a storage reel (3), wherein for storing the objects (1), as the belt (2) is unwound from a belt coil (5) on the belt reel (6) the objects (1) to be stored are wound together with the belt (2) onto the storage reel (3) for the formation of a storage coil (7), and for delivering the stored objects (1), said belt (2) together with previous stored objects are unwound from the storage coil (7) as the belt (2) is wound onto the belt coil (5), comprising guide means (31, 32) for guidingly supporting the storage reel (3) and belt reel (6) for substantially vertical displacement;

a first fixedly mounted backing roller (12) and a second fixedly mounted backing roller (13) supporting the storage coil (7) and belt coil (5) respectively;

reversible belt drive means (9, 10, 40) in engagement with said belt (2) for alternately withdrawing the belt (2) from the belt coil (5) and the belt together with stored objects (1) from the storage coil (7), thereby rotating in the unwinding direction the belt coil (5) or the storage coil (7), respectively, and the said first or second backing roller (12, 13) supporting the respective coil; and transmission means (51–54, 57–60) operatively connected for transmitting the rotation of the first or second backing roller (13, 12) supporting the respective belt coil (5) and storage coil (7) which is rotating in the unwinding direction, to the other respective first or second backing roller (12, 13) for rotating the other respective storage coil (7) or belt coil (5) in the windup direction such that the circumferential speed of the other respective first or second backing roller (12, 13) in the windup direction slightly exceeds the circumferential speed of the respective backing roller (13, 12) rotating in the unwinding direction, thereby tensioning the belt (2).

2. The device according to claim 1, and said transmission means including; a first transmission system (51–54) having, a first drive wheel (52), a first overrun clutch (53) connected to said second backing roller (13) and to said first drive wheel (52), said first overrun clutch (53) operative to drive said first drive wheel (52) by said second backing roller (13) when rotating in the direction which corresponds to the unwind direction of the belt coil (6), a first take-off wheel (51) connected to said first backing roller (12), and first means (54) connected for transmitting the rotation of said first wheel (52) to said first take-off wheel (51);

a second transmission system (57–60) having, a second drive wheel (58), a second overrun clutch (59) connected to said first backing roller (12) and to said second drive wheel (58), said second overrun clutch (59) operative to drive said second drive wheel (58) by said first backing roller (12) when rotating in the direction which corresponds to the unwind direction of the storage coil (7), a second take-off wheel (57) connected to said second backing roller (13), and second transmission means (60) connected for transmitting the rotation of said second drive wheel (58) to said second take-off wheel (57);

and a torsionally elastic clutch (25) connected in the transmitting train of at least one of said first and second transmission systems.

3. A storage device for sheet-like, flexible objects, especially bank notes, having a belt (2) connected between a belt reel (6) and a storage reel (3), wherein for storing the objects (1), as the belt (2) is unwound from a belt coil (5) on the belt reel (6) the objects (1) to be stored are wound together with the belt (2) onto the storage reel (3) for the formation of a storage coil (7), and for delivering the stored objects (1), said belt (2) together with previously stored objects are unwound from the storage coil (7) as the belt (2) is wound onto the belt reel (6), comprising guide means (31, 32) for guidingly supporting the storage reel (3) and belt reel (6) for substantially vertical displacement;

a first fixedly mounted backing roller (12) and a second fixedly mounted backing roller (13) supporting the storage coil (7) and belt coil (5), respectively, whereby the distances of said first and second backing rollers (12, 13) from said storage reel (3) and belt reel (6), respectively, varies with the diameters of the storage coil (7) and belt coil (5), respectively;

reversible belt drive means (9, 10, 40) connected for selectively withdrawing the belt (2) from the belt coil (5) or the belt together with stored objects (1) from the storage coil (7), thereby rotating in the unwinding direction the belt reel (6) or the storage reel (3), respectively;

transmission means (42–44, 46–48, 51–54, 57–60) operatively connected with said belt reel (6) and storage reel (3) for transmitting the rotation of said belt reel (6) or storage reel (3) which is rotating in the unwind direction to the respective other of said storage reel (3) or belt reel (6) to windup said belt (2) thereon, said transmission means including infinitely variable speed transmission means (42–44, 46–48) controlled in dependence on the distances of said first and second backing roller (12, 13) from said storage reel (3) and belt reel (6), respectively, whereby the circumferential speed of the coil on the respective other of said storage reel (3) and belt reel (6) slightly exceeds the circumferential speed of the coil on the corresponding belt reel (6) or storage reel (3), thereby tensioning the belt (2); and a torsionally elastic clutch (25) and frictional transmitting means (42, 43, 51, 52) connected in the transmission train of said transmission means (42–44, 46–48, 51–54, 57–60).

4. The storage device of claim 3, in which said transmission means includes a first friction drive (42, 43) having a friction plane (42) fixed to said storage reel (3), a first shaft (44), a first friction wheel (43) fixed on said first shaft (44) and arranged in a plane which is tangential to said first backing roller (12) and to the storage coil (7) supported thereon;

a second friction drive (46, 47) having a friction plane (46) fixed to said belt reel (6), a second shaft (48), a second friction wheel (47) fixed on said second shaft (48) and arranged in a plane which is tangential to said second backing roller (13) and to the belt coil (5) supported thereon;

a first transmission system (51–54) having a first drive wheel (52), a first overrun clutch (53) connected to said second shaft (48) and to said first drive wheel (52), said first overrun clutch (53) operative to drive said first drive wheel (52) when said second shaft (48) rotates in a direction corresponding to the unwind direction of said belt reel (6), a first take-off wheel (51) fixed on said first shaft (44), and first means (54) connected for transmitting the rotation movement of said first drive wheel (52) to said first take-off wheel (51);

a second transmission system (57–60) having, a second drive wheel (58), a second overrun clutch (59) connected to said first shaft (44) and to said second drive wheel (58), said second overrun clutch (59) operative to drive said second drive wheel (58) when said first shaft (44) rotates in a direction corresponding to the unwind direction of said storage reel (3), a second take-off wheel (57) fixed on said second shaft (48), and second means (60) connected for transmitting the rotation movement of said second drive wheel (58) to said second take-off wheel (57);

and the first and second friction wheels (43, 47) having identical diameter, wherein the output rotation of each of said first and second transmission systems (51–54, 57–60) slightly exceeds the input rotation thereof, thereby tensioning the belt (2).

5. A storage device according to claim 3, in which said storage reel (3) and belt reel (6) each having an axle (15, 16), two gear wheels (37, 38), each fixedly connected to one end of a respective said axle (15, 16); and said guide means (31, 32) respectively including rack gear means (34, 35) extending in the displacement direction, and each of said rack gear means (34, 35) meshing with one of said gear wheel (37, 38).

6. A storage device according to claim 1 or 3, in which said reversible belt drive means (9, 10, 40) include a roller pair (9, 10) providing a nip therebetween for receiving and delivering the objects (1), and said belt (2) extending about one of said rollers (9) of said roller pair and through the nip.

7. A storage device according to claim 1 or 3, in which said belt (2) extending between said reversible belt drive means (9, 10) and the storage coil (7) forms an obtuse angle with the line of displacement (20) of said storage reel (3) in said guide means (31).

8. A storage device according to claim 1 or 3, including at least one holddown means and stripper (18) positioned adjacent said belt (2) between said reversible belt drive means (9, 10) and the storage coil (7), for holding down the objects (1) to be stored on said belt and for stripping off stored objects to be delivered from the unwound belt.

9. A storage device according to claim 1 or 3, including a conveying track connected adjacent said reversible belt drive means (9, 10, 40), said conveying track having a first conveying route (84) for feeding the objects (1) to be stored and a second conveying route (85) for carrying away the objects (1) to be delivered, respectively, to and from the belt drive means (9, 10), a pair of baffles (88, 89) converging in a curved shape toward the belt drive means connected with said conveying track, a switch having a core member (94) connected in said conveying track, said core member (94) having a first position defining with one baffle (88) of said pair of baffles a feed route for said first conveying route (84), and having a second position defining with the other baffle (89) of said pair of baffles a delivery route for said second conveying route (85).

10. A storage device according to claim 1 or 3, in which said belt (2) comprises two belts travelling together at a mutual spacing, said belt reel (6) correspondingly comprising a pair of coaxial belt reel parts, a belt reel shaft (29), and a differential gear (28) connected on said belt reel shaft (29) for driving said belt reel parts by said belt reel shaft, and vice versa.

11. A storage device according to claim 3, including a second belt (68), a second belt reel (67) connected to said second belt (68), and means (78) drivingly connecting said belt reel (6) to said second belt reel (67);

said second belt (68) being connected to be wound onto and unwound from said storage reel (3) in overlying position with and together with said belt (2), with the objects (1) therebetween, and simultaneously unwound from and wound onto said second belt reel (67), and vice versa.

* * * * *